US005324025A

United States Patent [19]

Chadwick et al.

[11] Patent Number: 5,324,025

[45] Date of Patent: Jun. 28, 1994

[54] PHYSICAL DELAY BUFFER FOR PAPER ITEMS

[76] Inventors: Charles M. Chadwick, 17 Pettipaug Ave., Old Saybrook, Conn. 06475; Peter D. Hotkowski, 80 Middlesex Ave., Chester, Conn. 06412; Michael W. Raymond, 56 Stonehedge La., Bolton, Conn. 06043; Michael D. Strange, 791 Reservoir Rd., Cheshire, Conn. 06043; Frank A. Todaro, 5 Boulder Dr., Old Saybrook, Conn. 06475; William Wheeler, 33 Gottier Dr., Vernon, Conn. 06066

[21] Appl. No.: 947,066

[22] Filed: Sep. 18, 1992

[51] Int. Cl.[5] ..... B65H 29/54

[52] U.S. Cl. ..... 271/306; 271/903; 271/184; 198/803.1; 198/457

[58] Field of Search ..... 271/2, 69, 177, 184, 271/225, 270, 306, 307, 308, 903; 198/803.1, 803.7, 483.1, 457

[56] References Cited

U.S. PATENT DOCUMENTS

| | | | |
|---|---|---|---|
| 1,810,859 | 6/1931 | Thurmer | 198/803.7 |
| 3,526,170 | 9/1970 | Oderman et al. | 271/69 x |
| 3,759,508 | 9/1973 | Jeppsson | 271/69 |
| 4,367,997 | 1/1983 | Schweingruber | 271/184 X |
| 4,940,219 | 10/1992 | Volat | 271/306 X |
| 5,052,679 | 5/1992 | Sekino | 271/69 |
| 5,110,108 | 1/1983 | Muller | 271/184 X |

FOREIGN PATENT DOCUMENTS

| | | | |
|---|---|---|---|
| 279230 | 10/1914 | Fed. Rep. of Germany | 271/177 |
| 382768 | 12/1964 | Switzerland | 198/803.7 |
| 0796141 | 1/1981 | U.S.S.R. | 271/184 |

*Primary Examiner*—H. Grant Skaggs
*Assistant Examiner*—Carol Lynn Druzbick
*Attorney, Agent, or Firm*—Chilton, Alix & Van Kirk

[57] ABSTRACT

A mechanical buffer for imparting a substantial delay to paper items, such as envelopes which are being individually and sequentially conveyed in a high-speed paper transport system, maintains physical separation between the conveyed items and does not require termination of item movement or item encoding. The buffer employs a directional translation of item motion, i.e., envelope motion in the length-wise direction is changed to motion in the direction of thickness, to achieve a velocity-distance compression. The buffer apparatus includes a continuous loop of item carriers which are individually positioned to have incoming items sequentially and individually inserted therein, the carriers imposing a retarding frictional force proportional to item thickness and mass to arrest item motion in the longitudinal direction as the direction of item motion undergoes the translation.

18 Claims, 5 Drawing Sheets

PHYSICAL DELAY BUFFER FOR PAPER ITEMS

BACKGROUND OF THE INVENTION

1. Field of the Invention

The present invention relates to the sequential processing of items bearing printed indicia, envelopes having address information printed thereon for example, and particularly to the introduction of an extended time delay in the transport of such items while maintaining physical separation between the sequentially moving items and without discontinuing item movement. More specifically, this invention is directed to apparatus which introduces an extended time delay in the path of a high-speed, linear sequential document transport and especially to a buffer device which intercepts a stream of indicia bearing paper items, changes the direction and velocity of motion thereof and subsequently delivers the items to a downstream high-speed transport without any interruption in the continuous movement of the items and without commingling of the items. Accordingly, the general objects of the present invention are to provide novel and improved methods and apparatus of such character.

2. Description of the Prior Art

While not limited thereto in its utility, the present invention is particularly well suited for use in a mail processing system where address information on envelopes is "read" electronically, postal ZIP-Codes corresponding to the addresses are determined and bar codes corresponding to the postal ZIP-Code information are printed on the envelopes. In such a mail processing system, an envelope imaging camera located along a high-speed linear document transport, typically at a point immediately downstream of an envelope feeder, initiates a complex, high-speed, computer-pipelined, queue of linearly-segmented processes that must be completed by the time the envelope reaches a downstream sorter and bar code printer. These processes include capture and recording of an image of the envelope, locating the address information, employing optical character recognition technology to "read" the address and looking-up the 11-digit postal ZIP-Code for the address in a national address directory database. These process steps must be performed while attempting to manage and recover from various "normal" error conditions. The "answer" derived from these processes for a specific envelope must be available by the time that envelope reaches the printer in order to avoid having the envelope routed to a "reject" hand sortation bin. Since the envelopes are moving at a continuous velocity, all of the processes must be performed in real-time. This absolute real-time requirement has, in the past, resulted in relatively high "reject" rates.

In an optimally realized system design for applications such as mail bar coding, the summed segmented-process times (pipe-line time) may be quite substantial. Accordingly, in the interest of minimizing the reject rate, very long transports have been employed. For example, mail bar coding systems are known which employ a long, serpentine-like belt path between the point of document imaging, i.e., the process start point, and the bar code printer station, i.e., the process deadline point. It is to be noted that the amount of time required to complete any process step in the system may vary from item to item. The total summed pipe-line time, accordingly, is variable and can be statistically expected to sometimes achieve extreme values. Under such circumstances, the best sub-process management design scheme is typically a linear process queue with a queued buffer between successive process stages. It is well known that designs which allow longer queue lengths, length being a function of time and distance, always achieve higher performance levels by virtue of better use of available resources. However, transport design factors that mitigate against optimizing queue length for an application such as mail bar coding include:

a. longer distances occupy greater space and require more costly transport mechanics, b. longer distances result in more items being queued, and c. increasing the number of queued items increases the demands on item tracking and preservation of sequence fidelity as the items converge with the computer process output at the process deadline point.

Because of the factors discussed above, virtually all high-speed linear-sequential paper item transports presently used in processes which require significant pipe-line delays compromise realization of an ideally long pipe-line process time to accommodate mechanical and control realities of high-speed paper movement. In some applications, high-speed image-based check processing for example, a "two-pass" approach is implemented wherein linkage information is printed on each item during the first pass and is read on the second pass with the time lapse between successive passes allowing "off-line" completion of item information processing from image. In other applications, the processing of selected items is "aborted" when completion time requirements are exceeded. Under such circumstances, the ejected or offending items are mechanically routed to a reject bin for manual exception handling.

Another prior art approach to achieving necessary pipe-line delays has been to employ an intermediate stacker/document accumulator. This approach necessarily dictates that the transport system be provided with a secondary document feeder which extracts items from the accumulated stack. In principle, resort to use of an intermediary stack of accumulated items allows a long process delay-time. However, all document feeders, a document feeder being a device which when functioning properly both singulates and advances the paper items being processed, have two failure modes. A failure to feed or advance a document, i.e., a paper jam, is 100% detectable. However, a singulation failure, i.e., the simultaneous feeding from the stack of plural items, is not always detectable and will cause loss of linkage fidelity. Restated, two paper items stuck together at initial infeeding might separate on out-feeding or two successive items separately in-fed may out-feed together. Either event leads to the loss of linkage or registration of two queues, i.e., the mechanical or item queue and the computer process queue, which were in registration at an initial point. Once linkage fidelity is loss, all successive items are processed erroneously and the occurrence of these linkage failure errors will not be detectable by the system.

SUMMARY OF THE INVENTION

The present invention overcomes the above-briefly described and other deficiencies and disadvantages of the prior art and, in so doing, provides a novel technique for introducing an extended time delay in the paper-item traversal path of a high-speed sequential linear document transport without terminating item movement and without sacrificing the physical separation of the sequential individual document flow. The present invention also encompasses a novel mechanical delay buffer which implements this novel process.

In providing the above-mentioned process and apparatus, the invention achieves processing pipe-line delays of significant duration in a more compact and economic manner than previously accomplished. The present invention also permits the achievement of physical pipe-line delay times of sufficient duration to permit new and additional processes, including those required on an exceptional basis and/or those involving human intervention, to be interposed into an information processing scheme without slowing or interrupting high-speed document feed and imaging. The accomplishment of the foregoing objects, in turn, precipitates the advantages of allowing optimal design and programming of any computer and electronic processes which are to be executed during the pipe-line delay. Similarly, as a result of practice of the present invention, it may be insured that information derived from a document at a particular point in its path of travel will reliably converge with the same document at a predetermined later point in its path of travel.

The present invention is, in part, based upon realization that three dimensional indicia bearing paper items which are to be processed while moving along a transport system have relatively large horizontal (length) and vertical (height) dimensions and limited thickness. In accordance with a preferred embodiment of the invention, a horizontally arrayed buffering apparatus is interposed between two offset sections of a conventional linear-sequential item transport. The buffering apparatus arrests linear and longitudinal high-speed document motion, which is conventionally in the direction of document length, and translates the document motion to a substantially reduced velocity in a direction which is angularly related to the original motion path. In the embodiment to be described, the reduced velocity motion, is in terms of the item itself, in a direction which corresponds to the thickness dimension of the document, i.e., the width of the item. Restated, considering the item, the change in direction is 90° although the path of motion need not change by the same angle. The buffering apparatus is configured to sequentially receive and support a multiplicity of items. The number of items in transit within the buffering apparatus realizes a proportional pipe-line delay period. On extraction from the buffering device, linear-longitudinal, high-speed item motion is resumed. The buffering apparatus of the present invention provides sufficient time for completion of a computer process or a complex pipe-line of computer processes which are started before the item enters the buffering device, the computer processes being completed before the item reaches a deadline point located immediately after buffering apparatus exit. In summary, the present invention achieves a velocity-distance compression as a result of the directional translation of item motion while preserving the individual item input sequence. Accordingly, very extended pipe-line delay times can be achieved in a very limited space.

A buffering apparatus in accordance with the present invention simultaneously performs the functions of maintaining separation between paper item(s) which are in-fed and advancing the separated items. In performing these functions, the preferred embodiment of the invention comprises a continuous loop conveyor which includes a multiplicity of identical buffer carriers positioned at close and equal intervals. The carriers are designed to receive and hold an individual paper item and preserve both item isolation and sequential fidelity. It is to be noted that, if plural items are simultaneously fed in, such plural items will remain grouped together and will be extracted from the buffer apparatus as if they were a single item. The conveyor advances the item carriers, hereinafter referred to as "pockets", in a direction which is orthogonal to the long-axis of the pockets and in the direction which is commensurate with the smallest dimension of the items being transported. During such advancing, the pockets will individually come into general registration with an insertion mechanism which is positioned to receive a sequence of paper items which are traveling in a linearly longitudinal manner. These items will, in the order in which fed, be inserted, caught and retained in an empty buffer pocket. The advance of the conveyor which carries the buffer pockets is controlled such that a new, empty buffer pocket is always available and properly positioned to receive the next arriving paper item. An extractor mechanism is positioned, at a point commensurate with the desired time delay, on the path of buffer pocket travel. The extractor mechanism will remove the contents of the juxtapositioned pocket and deliver the thus removed item onto a downstream conveyor which, in the typical operating environment, will be a further linear item transport. The extractor thus maintains item registration (linkage) even if there has been an upstream singulation (feed) error. The empty buffer pocket will then continue along the closed loop conveyor path and return to the point of document insertion.

BRIEF DESCRIPTION OF THE DRAWINGS

The present invention may be better understood, and its numerous objects and advantages will become apparent to those skilled in the art, by reference to the accompanying drawing wherein like reference numerals refer to like elements in the several figures and in which.

DESCRIPTION OF THE DISCLOSED EMBODIMENT

Figure 1:
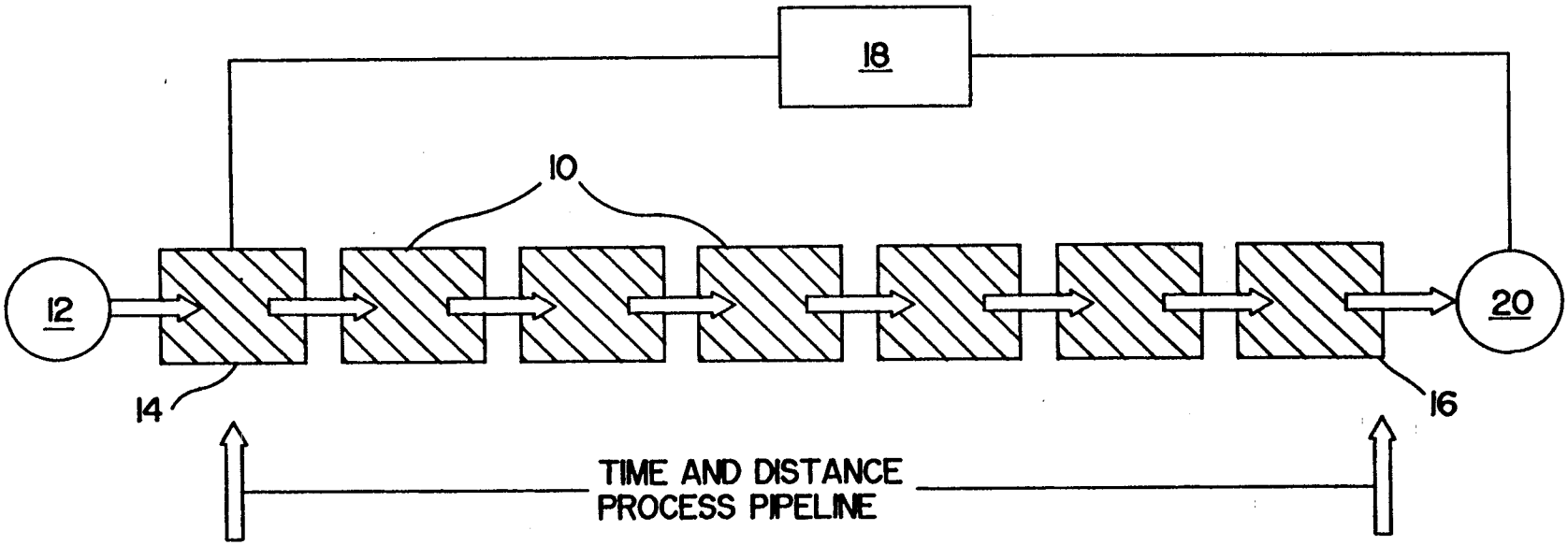
FIG. 1 schematically illustrates the problem to which the present invention is directed.

With reference to FIG. 1, the basic problem addressed by the present invention is depicted schematically. In accordance with conventional prior art practice, a continuous sequence of paper items 10 are directed, by means of an infeeding device 12, onto a linear-sequential transport. Typically, shortly after infeeding (at point 14) a computerized information extraction process is started for each item. That is, the items 10 will sequentially pass an electronic camera and be imaged for purposes of optical character recognition. The character recognition process, and any other related computer processes such as ZIP-Code look-up, must be completed by the time the item 10 has reached a process deadline point 16. The deadline point 16 represents when and where the divergent computerized process that started earlier must reliably converge with the path physically followed by the item 10 so that the information derived from the computer process, as performed in computer 18, can control additional item-specific processes by the downstream paper-receiving device 20. The downstream process or processes may include such tasks as sorting and bar code printing. The distance between the process starting point 14 and the deadline point 16 establishes a delay time, hereinafter the "pipe-line delay", that cannot be less than the time required for process completion in computer 18. Lengthy process completion times dictate an extended transport distance between points 14 and 16. When high rates of item throughput are required, many items 10 may be sequentially in transit at the same time along the transport. Obviously, the task of ensuring that information derived from a particular item is correctly matched with that item's physical arrival at the deadline point 16 is a formidable task and the magnitude of this task increases with the rate of item throughput and the distance between process starting point 14 and deadline point 16.

Figure 2:
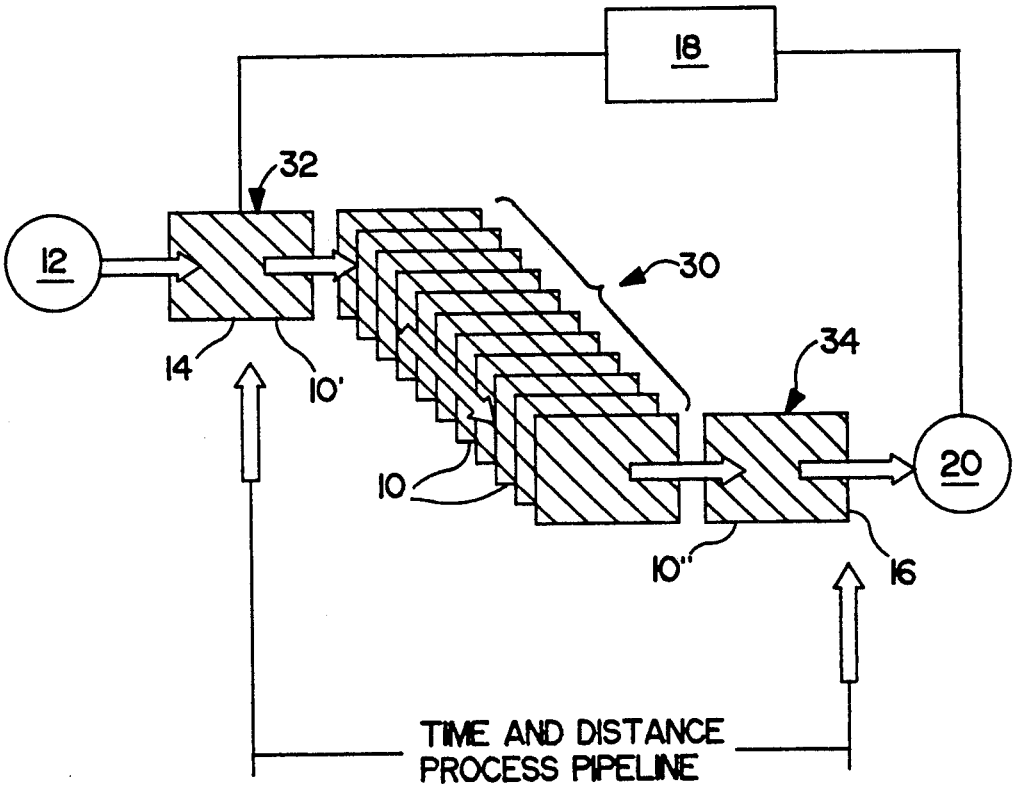
FIG. 2 schematically illustrates the operation of a buffered conveyor system in accordance with the present invention.

With reference to FIG. 2, the present invention addresses the above-discussed problem by taking advantage of the fact that the paper items 10 being handled have horizontal and vertical dimensions which are very large compared to item thickness and, in order to permit image capture, these items are typically moved in the direction of their longest dimension. In accordance with the invention, a horizontally arrayed buffering apparatus, indicated generally at 30, is interposed between two offset sections 32, 34 of a conventional linear-sequential item transport. Linear and longitudinal high-speed document motion from the infeeding device 12 is arrested by the buffering apparatus 30 and translated to a much reduced velocity of motion. In terms of the three dimensional document itself, the directional change is 90° and the new direction of motion is in the same direction as the item thickness dimension. The buffering apparatus 30, as will become apparent from the discussion of FIGS. 3–7, holds a multiplicity of items. The number of items in horizontal transit within the buffering apparatus 30 realizes a proportional pipe-line delay period. At a point which corresponds to the requisite time delay, the items 10 are extracted from the buffering apparatus 30 and linear-longitudinal, high-speed item motion is resumed. The buffering apparatus 30 thus provides time for a computer process or complex pipe-line of processes performed by computer 18, which were started before buffer apparatus entry, to be completed before the item 10 reaches the deadline point 16 located immediately after the buffer exit. Restated, the velocity/distance compression which results from the directional translation of item motion allows very extended pipe-line-delay times to be achieved in very limited space.

Figure 3:
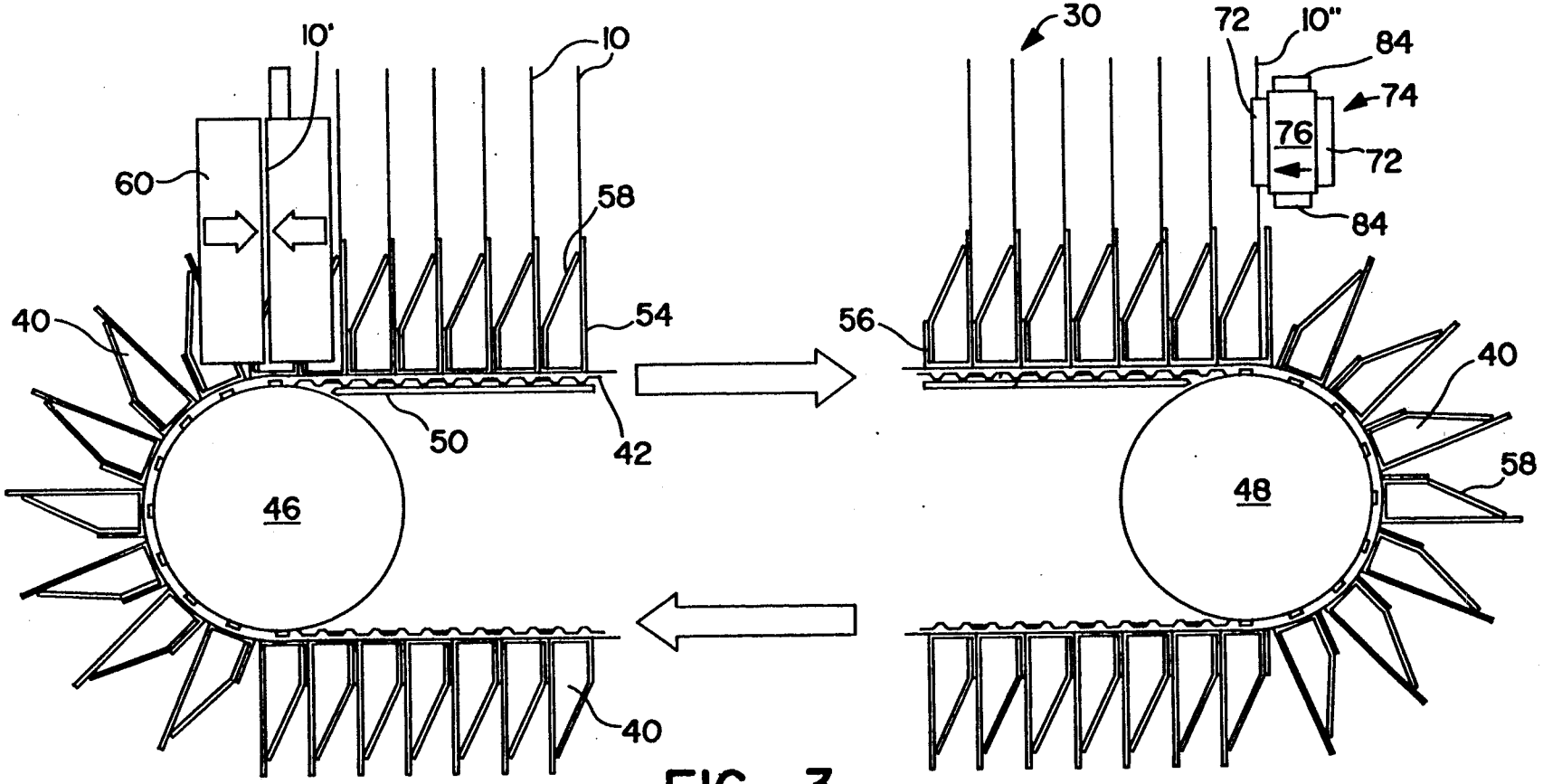
FIG. 3 is a schematic side elevation view of buffering apparatus for use in the conveyor system of FIG. 2.
Figure 4:
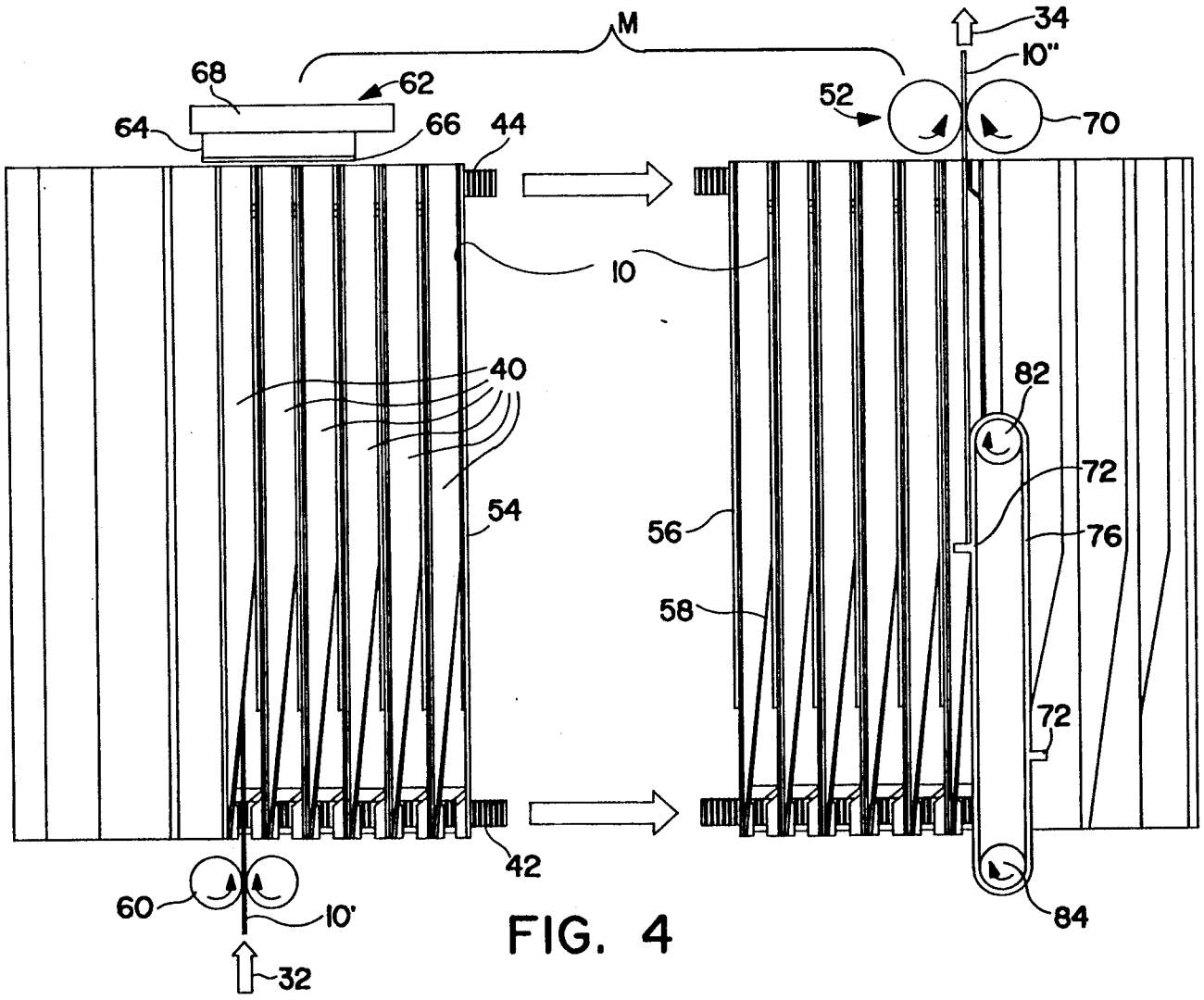
FIG. 4 is a schematic top view of the buffering apparatus of FIG. 3.

With reference now to FIGS. 3 and 4, buffering apparatus 30 for use in the practice of the present invention has a multiplicity of individual buffer pockets 40 which are mounted at close and equal intervals on a pair of parallel drive belts 42, 44. The pockets, the components of which are shown in FIGS. 5 and 6, and drive belts cooperated to define a continuous loop of buffer-pockets. As viewed from above in FIG. 4, the top edges of the paper items 10, envelopes for example, are visible. The path of linear longitudinal envelope travel is from the lower left of the Figure to the upper right. As viewed from the side in FIG. 3, the path of linear longitudinal envelope travel is from the viewer through the drawing, the trailing ends of the envelopes 10 being visible in FIG. 4. Thus, in the disclosed embodiment, the continuous loop of buffer pockets rotates in the clockwise direction. The newest arriving, length-wise traveling envelope 10' will be inserted into the left-most, top, vertically oriented buffer pocket 40, while the oldest buffer-retained envelope 10" is concurrently removed from the right-most, top, vertically oriented buffer-pocket to resume its length-wise travel. The buffer apparatus 30 thus defines a fixed-length, mechanical envelope delay. Presuming that there has been no in-feed failure at or or upstream of point 14, each envelope contained within the buffer-active zone M, defined by the number of pockets 40 between the insertion and extraction points, is held within its own buffer-pocket 40. Accordingly, both sequential and singulation fidelity of the original input to the conveyor system is fully preserved.

Implementation of the present invention relies upon the employment of buffer-pockets 30 that catch, arrest and retain a paper-item in a continuous stream of arriving items, holding it singularly from and in original order with respect to other paper items in the stream until such time as it is individually removed from its retaining pocket. The buffer-pockets 30 can be defined by mechanisms other than the channel defining devices shown in FIGS. 3–7. Further, the transport path defined by the buffer apparatus need not be in a direction which is transverse to the input and output conveyors nor does the present invention impose any limitation on the spacing, in terms of numbers of pockets, between the paper item insertion and extraction positions. The buffer-pocket movement may be implemented in a variety of different rotational shapes, either clockwise or counter-clockwise, and the relative points and directions of buffer-pocket insertion and removal may be arranged in any set of logical combinations including any tangential angular reference to the path followed by a buffer-pocket.

The drive belts 42 and 44 extend about two horizontally offset pulley pairs 46 and 48. The pulleys comprising each pair are mounted on common axle/bearing block assemblies, not shown, such that a clockwise rotational force applied to the drive pulley assembly 48 will cause the belt-loop to rotate about the idler pulley assembly 46. A rigid slide plate 50 supports the top, horizontal run of the buffer loop. Obviously, other drive means for imparting movement to the buffer-pockets, a chain drive for example, could be utilized.

As may be seen by joint consideration of FIGS. 3 and 4, the length of the buffer-pockets 30 is greater than the longest length of the envelopes or other paper items 10 to be handled. The width of the buffer-pockets 30 is substantially less than envelope (paper item) length, leading to the desired distance/velocity compression relative to the axis of linear-longitudinal travel. The height of the buffer-pockets 30 is, in the disclosed embodiment, less than the minimum expected paper item height due to the nature of the extractor mechanism which is employed. Each of the buffer-pockets 30 is generally in the form of an open ended channel defined by a forward wall 54 and a rear wall 56. The forward wall 54 is of greater height than the rear wall 56 in the disclosed embodiment. A flexible retainer/arrestor member 58 is provided within each pocket. The retainer/arrestor members are, in the disclosed embodiment, in the form of flat springs which are sized and shaped to resiliently bias the paper items 10 into a vertical position against the surface of the rigid buffer-pocket forward wall 54. As may be seen by FIG. 4, the retainer/arrestors 58 define a wide and progressively narrowing buffer-pocket mouth which tapers from rear wall 56 toward the inside surface of the retainer pocket forward wall 54. The retainer/arrestors members thus guide paper items during insertion into the buffer-pockets and, because of the relatively wide buffer-pocket mouths, minimize the precision of motion control required for advancing of the buffer-loop.

The arrival of an empty buffer-pocket 30 into alignment with the in-feed or upstream linear paper transport 32 will coincide with the engagement, by pair of inserter pinch rollers 60, of a paper item 10. The paper item 10 will thus be driven into the waiting buffer-pocket. If plural items arrive together at pinch rollers 60, such item will be fed into a buffer pocket together. As the paper item 10 enters the buffer-pocket it will encounter the portion of the retainer/arrestor member 58 which tapers from the buffer-pocket rear wall 56 toward the forward wall 54. The paper item 10 will be guided by the tapered retainer/arrestor member to and through the pinch point or gap between the free end of the retainer/arrestor member 58 and wall 54. The spring force exerted by the retainer/arrestor member 58, in combination with the friction between the moving paper item 10 and the wall 54, will result in the momentum of the inserted paper item 10 being progressively absorbed by a braking force which gradually increases in the direction of insertion. As a consequence of the inserter pinch rollers 60 being located close to the buffer-pocket mouth, and as a further consequence of the retainer/arrestor member 58 having the proper spring characteristics, the incoming envelope or other paper item 10 will be driven fully into the buffer-pocket. If paper item motion has not been fully arrested by the time it reaches the end of the buffer-pocket located opposite to the mouth, the leading edge of the item will strike a damping assembly 62. The damping assembly 62 is, in the disclosed embodiment, comprised of a resilient damping member 64, for example a sponge or the like, which is provided with a face plate 66 having a surface coated with a material having a low coefficient of friction. The damping member 64 is affixed to a rigid plate 68.

The extractor 52 of the disclosed embodiment employs a pair of continuously operating extractor pinch rollers 70. An envelope which moves into the gap between the extraction drive pinch rollers 70 from a properly positioned buffer-pocket 30 will be engaged and pulled length-wise from the buffer-pocket. FIG. 4 depicts the "oldest" paper item 10" in the process of being "pulled" from a buffer-pocket as a consequence of having been "pushed" into the grip of the rollers 70 by an active tab 72 on a dual-tab extractor belt assembly 74. The tab 72 will expel the contents of the buffer pockets, be it one or plural envelopes, and thus will maintain registration if there has been an upstream singulation error. Each extraction cycle consists of a 180° rotation of the belt 76 of the extractor belt assembly 74. It is to be noted that, in the disclosed embodiment, the belt loop 76 of the extractor belt assembly 74 will come to a momentary stopped resting position between extraction cycles with a tab 72 positioned close to the end of the buffer-pockets, i.e., close to where the edge of the next paper item 10" will arrive. Thus, at the end of an extraction cycle, the previously inactive tab 72 is positioned to become the active tab on the next extraction cycle. As may be seen from FIG. 3, the extractor belt assembly 74 is vertically positioned so that an empty buffer-pocket will pass beneath it as it begins its return path to the insertion point.

Figure 5A:
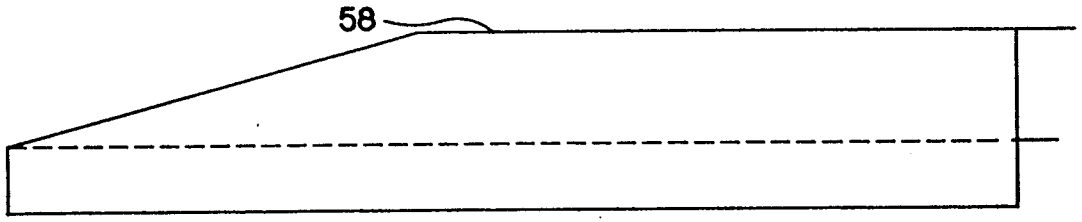
FIGS. 5A and 5B depict the construction of a retainer/arrestor device which forms part of a buffer-pocket of the apparatus of FIGS. 3 and 4.
Figure 5B:
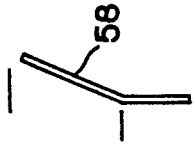

Referring now to FIGS. 5A and 5B, the retainer/arrestor members 58 of the buffer-pockets 30 are fabricated from rectangular flat stock comprised of a plastic material such as "Delrin". A corner of such rectangular stock is removed to create a buffer-pocket guide shape. As indicated by the dashed fold line, a longitudinal spring-bend is imparted to the component by means of a heated folding die.

Figure 6A:
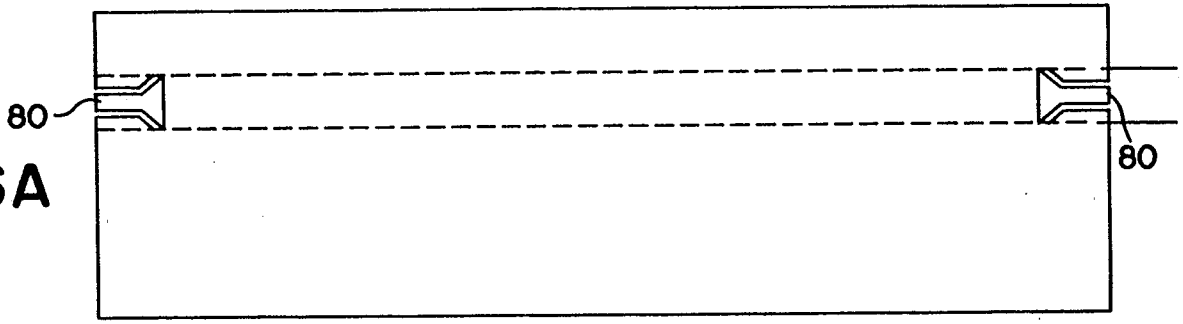
FIGS. 6A and 6B depict the construction of a buffer-pocket channel for use in the apparatus of FIGS. 3 and 4.
Figure 6B:
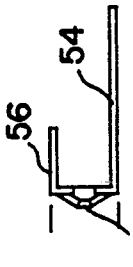

Referring to FIGS. 6A and 6B, the buffer-pockets or channels can be fabricated from a length of "J-shaped" PVC extrusion. The bottom of this extrusion is shaped, by means of a tab-cutting die, at the two opposite ends to form a pair of buffer-pocket drive-belt mounting tabs 80. The use of these mounting tabs enables easy installation of the buffer-pockets on the toothed drive belts 42 and 44.

Figure 7A:
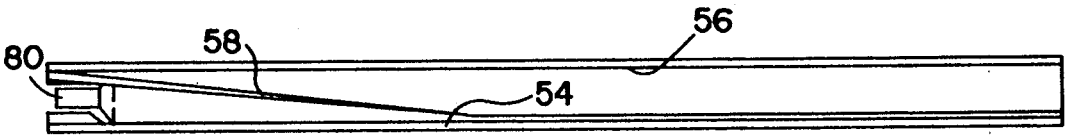
FIGS. 7A and 7B are respectively top and side elevation views of a buffer-pocket comprising the components of FIGS. 5 and 6.
Figure 7B:
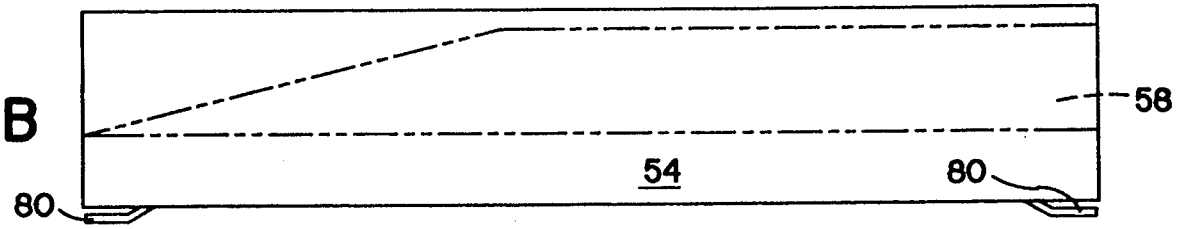

An enlarged top view of an assembled buffer-pocket is depicted in FIG. 7 and, in the disclosed embodiment, the arrestor/retainer member 58 is adhesively bonded to the rear wall 56 of the pocket.

The buffer-pockets 30 in accordance with the present invention must catch and arrest incoming envelopes that have a fixed velocity while varying in dimensions and mass. Even ignoring the effect of the continuing influence of a driving force applied by the inserter pinch rollers 60 to a long envelope, as opposed to a shorter envelope, the buffer-pockets must be able to accommodate approximately a sixteen fold variability in the momentum that must be gradually arrested as a consequence of variable envelope mass. The single factor which has the greatest influence on momentum is envelope thickness. Variations in envelope thickness are addressed by establishing a retainer/arrestor member 58 spring constant that, in combination with the gap or pinch space between the retainer/arrestor member and the buffer-pocket forward wall 54, will ensure full and reliable insertion of the longest/thinnest envelopes expected to be processed and by selecting the thickness of the retainer/arrestor member 58 so as to ensure gradual slowing of the thickest/heaviest items. The arrestor damping assembly 62 was incorporated to accommodate any residual variance attributable to items which have a relatively high momentum as a consequence of being long and tall, and thus relatively high mass, while being modestly thick.

It is to be observed that those factors which operate to properly arrest high mass items being inserted into the buffer-pockets also provide an increased retentive force. However, since envelope "stiffness" is very nearly perfectly corollated with thickness, the intrinsic stiffness of thicker, higher mass items 10 allows the retentive forces to be overcome by the extractor belt assembly 74 without buckling of the items 10. Thus, the above-discussed design of the buffer-pockets 30 effectively self-compensates for paper item variability in mass on insertion by virtue of the fact that the arresting frictional force is a co-variant of item thickness, and the articulating factor of "push-extraction" compensates for a corresponding variation in pocket-retentive frictional force by virtue of item stiffness being a co-variant of item thickness.

As noted above, the disclosed embodiment of an extractor mechanism in accordance with the invention includes an extractor pinch roller mechanism comprised of rollers 70 driven in continuous rotational motion at a constant surface velocity corresponding to the desired velocity of paper item linear longitudinal motion on the transport 34 which is downstream from the buffer assembly 30. Once a paper item(s) 10 has been advanced from a buffer-pocket into the grip of the pinch roller mechanism, it will be accelerated from the buffer-pocket with the buffer-pocket retainer/arrestor member 58 accommodating changes in paper item angle of attack with respect to the pinch roller mechanism as the buffer-pocket continues to advance. In accordance with the preferred embodiment, the rollers 70 have a height approximately equal to the anticipated height of the paper items and are mounted proximal to the exit side of the buffer-pockets. The surfaces of the rollers 70 will be comprised of a durable, compressible material to accommodate application-specific variability in item thickness and this material will also be selected to establish a high coefficient of friction on the application-specific repertoire of paper-stock encountered.

The belt assembly 74, which also forms part of the extractor mechanism, includes a pair of pulleys 82 and 84 and the dual-tab extractor drive, belt 76. The drive belt is in the form of a conventional, L-series timing belt. The tabs 72, which will typically be fusion bonded to the belt surface, have a degree of flexibility. The extractor belt 76 is driven in "on-off" fashion to produce the above-discussed 180° of belt rotation for each paper item extraction cycle. During the "on-off" extraction time of each cycle, the "active" tab 72 is caused to impact the trailing edge of the contents of the buffer-pocket, inextricably sweeping the item or items forward from the buffer-pocket to the pinch roller mechanism. The maximum tab velocity achieved during the extraction cycle will not exceed the surface velocity of the extractor pinch rollers.

In use of the present invention, the positioning and physical characteristics of the items inserted into buffer pockets which succcessively arrive at the insertion point will vary significantly. The extractor belt assembly 74, particularly the dimensions of the tab 72, takes these factors into account. In the interest of reliably ensuring the expulsion of the contents of a pocket, regardless of where in the sweep cycle of the active tab such contents are engaged, the pulley 84 of extractor belt 74 is positioned with its center line offset, to the left in FIG. 4, with respect to the left-most buffer pocket edge. It is also noteworthy that continuation of the tab sweep-cycle, so that it has a "follow-through" action, has been found to be important in ensuring that "short-/tall" items experience a clean and skew-free exit from the buffer pocket through the pinch rollers 70. The extractor belt assembly of the preferred embodiment of the present invention also is positioned such that the contents of a buffer pocket will establish contact with the flat surface of the "untabbed" extent of the extractor belt prior to the trailing edge of such contents being engaged by a tab. Under these conditions, the progressively increasing compressive friction between the envelope or other item and the moving belt surface, as engendered by the buffer pocket retainer/arrestor spring 58 being loaded by buffer-loop advance, pre-initiates envelope motion toward the pinch rollers 70 with the subsequent tab-impact being no more than a slight bump which ensures reliable and complete extraction.

In operation of the apparatus of the present invention, two fixed-excursion motions are supervised. These motions are the advance of the buffer loop to the next empty pocket "target zone" and the cycling of the belt extractor mechanism 74 to remove the "oldest" item retained in the buffer apparatus. In the control of these motions, only the advance of the buffer loop is referenced to an event outside the boundary of the buffering apparatus. That outside event is the arrival of the next incoming item at the insertion point, i.e., at the pinch rollers 60. The execution of a buffer extraction cycle is triggered by the buffer-loop having been advanced one buffer pocket width from its position at the last buffer pocket cycle. Thus, extraction of the "oldest" item is temporally referenced to insertion of the "newest" item. With proper extractor placement and fixed timing, the extraction cycle will work equally well with buffer-motion fully arrested or with the buffer loop in motion at maximum advance velocity.

The disclosed embodiment of the invention implements indexed buffer advanced motion executed in tandem with a synchronized in-feed device. In this implementation, the buffer loop is advanced in step-wise fashion with each movement excursion being precisely calibrated for optimal document insertion. When the advance mechanism hits its stop-point, an in-feeding and concurrent extraction cycle will be triggered. Because extraction has proven to be fail-safe, only the in-feeding processes are monitored for the purpose of motion control by means of a conventional transmission photocell located in the linear-longitudinal input document path immediately upstream of the buffer apparatus. The next move-cycle will be triggered with a fixed delay time after the trailing edge of the in-fed document has been sensed. Should document in-feeding be mechanically delayed, the control mode described will correspondingly delay the next move step. If the in-feeding device experiences a multiple feed, the described control mode will ensure that the plural concurrently fed items will enter the same buffer pocket and, in turn, this will ensure that the plural simultaneously in-fed items will ultimately be removed in parallel at the extraction point.

The above-briefly described operation of the buffer apparatus of the present invention will be accomplished under the control of a microprocessor which provides commands for a stepper-motor which provides the drive power for the buffer loop. Conventional control techniques will be utilized to ensure continued operational registration between mechanics and control software to take into account factors such as mechanical slippage or count/step tolerance build-up. It will be obvious to those skilled in the art that, because of inertial considerations, a complex sensing and motion control algorithm may be implemented by means of the control microprocessor to dynamically modulate the rate of buffer pocket advance motion to position the buffer pocket mouth at the proper point based upon advanced - photocell sensing of the next envelope or other paper item leading edge.

It is to be noted that the control of the present invention must accommodate the condition of an input feed interruption which forces the buffer advance mechanism be brought to a complete halt with an empty pocket positioned at the "target zone". When item feed is resumed, the controller is faced with the challenge of "catching" the first item in the resumed stream while also accelerating from a stopped position to "catch" the immediately following item in the next buffer pocket on the loop. The present invention permits a solution to this control problem by virtue of the fact that the width of the effective "target zone" comprised of the tapered buffer-mouth is substantial relative to the width of the "dead zone" between adjacent buffer pockets. Once an item has entered the mouth of a buffer pocket, complete insertion will be successful because of the spring-compliance of the retainer/arrestor members 58 and as a result of item bending about the inserter pinch rollers even though the buffer pocket is advanced into the next pocket "target zone" before insertion is complete.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A system for conveying paper items bearing machine readable indicia, the paper items having a length in each of three dimensions with the length in the first dimension being much smaller than the length in the other two dimensions, each of the dimension lengths defining a direction, the item first dimension being thickness, said system comprising:

first linear conveyor means for transporting the items in serial, spaced apart relationship in the direction of one of said other dimension lengths at a first velocity;

buffer means for receiving the items from said first conveyor means and transporting the said items, said buffer means denfining an item receiving station in alignment with said first conveyor means, said buffer means including a plurality of closely spaced item carriers which move along a continuous path, said path being angularly related to the direction of item motion on said first conveyor means, items transported on said first conveyor means being inserted individually and serially into an end of one of said carriers, said carriers moving said items in the direction of said item first dimension length at a second velocity which insures availability of an empty carrier to receive a next incoming item from said first conveyor means, said carriers each comprising means defining an open-ended channel for receiving an item, said channels having a pair of generally parallel walls, said carriers each further comprising means located in said channel for resiliently biasing an item disposed therein against one of said walls;

receiver conveyor means for transporting the items in serial, spaced apart relationship in the said direction of said one of said other dimension lengths, said receiver conveyor means being substantially in alignment with a discharge region of said buffer means defined path, said discharge region being displaced from said receiving station; and extractor means for removing the contents of said buffer means carriers and delivering the removed items to said receiver conveyor means.

2. The apparatus of claim 1 wherein said channels have an open receiving end which is substantially wider than the width of the largest expected item and wherein said biasing means defines a channel opening which tapers inwardly from said receiving end.

3. A system for conveying paper items bearing machine readable indicia, the paper items having a length in each of three dimensions with the length in the first dimension being much smaller than the length in the other two dimensions, each of the dimension lengths defining a direction; said system comprising:

first linear conveyor means for transporting the items in serial, spaced apart relationship in the direction of one of said other dimension lengths at a first velocity, said first conveyor means having a downstream end;

buffer means for receiving the items from said first conveyor means and transporting the said items, said buffer means defining an item receiving station in alignment with said first conveyor means, said buffer means including a plurality of closely spaced item carriers which move along a continuous path, said path being angularly related to the direction of item motion on said first conveyor means, items moving on said first conveyor means being inserted serially and individually into a said carrier, said carriers moving said items in the direction of said item first dimension length at a second velocity which insures availability of an empty carrier to receive a next incoming item from said first conveyor means, said carriers each include means for arresting the motion of item inserted into said carriers;

means positioned at the downstream end of said first conveyor means for inserting items into said buffer means carriers;

receiver conveyor means for transporting the items in serial, spaced apart relationship in the said direction of said one of said other dimension lengths, said receiver conveyor means defining a discharge station in alignment with a region on said buffer means which is displaced from said receiving station; a nd extractor means for removing items from said buffer means carriers and delivering the removed items to said receiver conveyor means.

4. The apparatus of claim 3 wherein said carriers each further include means defining an open-ended channel which includes generally parallely oriented forward and rear walls.

5. The apparatus of claim 4 wherein said arresting means is located in said channels and progressively, resiliently biases a received item against said forward wall.

6. A system for conveying paper items bearing machine readable indicia, the paper items having a length in each of three dimensions with the length in the first dimension being much smaller than the length in the other two dimensions, each of the dimension lengths defining a direction, said item first dimension being thickness, said system comprising:

first linear conveyor means for transporting the items in serial, spaced apart relationship in the direction of one of said other dimension lengths at a first velocity, said first conveyor means having a downstream end;

buffer means for receiving items from said first conveyor means and transporting the received items, said buffer means defining an item receiving station in alignment with said first conveyor means, said buffer means including a plurality of closely spaced item carriers which move along a continuous path, said path being angularly related to the direction of item motion on said first conveyor means, items transported on said first conveyor means being inserted serially and individually into a said carrier, said carriers moving said items in the direction of said item first dimension length at a second velocity which insures availability of an empty carrier to receive a next incoming item from said first conveyor means, each of said carriers defining a channel having a base, a pair of side walls and oppositely disposed entrance and discharge ends, the items being supported on an edge by the channel base, the items extending above said side walls;

receiver conveyor means for transporting the items in serial, spaced apart relationship in the said direction of said one of said other dimension lengths, said receiver conveyor means defining a discharge station in alignment with a region on said buffer means which is displayed from said receiving station; and extractor means for removing items from said buffer means carriers and delivering the removed items to said receiver conveyor means.

7. The apparatus of claim 6 wherein a portion of said extractor means is positioned over said buffer means and includes means for engaging an edge of an item to impart motion to the said engaged item in the direction of motion of said receiver conveyor means, said engaging means pushing the engaged item away from the end of the channel through which the item was inserted into the channel.

8. The apparatus of claim 7 wherein each of said carriers further includes motion arresting means located within the channel, said arresting means applying a resilient biasing force for urging an item against a wall of said channel and retaining the item in said channel, said engaging means overcoming said retaining force.

9. The apparatus of claim 8 further comprising:

means positioned at the end of said first conveyor means for inserting items into said buffer means carrier channels at approximately said first velocity.

10. The apparatus of claim 9 further comprising:

damping means positioned at a point disposed generally oppositely with respect to said inserting means for absorbing any momentum retained by an item which reaches the end of a said channel opposite to the insertion end.

11. The apparatus of claim 7 wherein said receiver conveyor transports the items at approximately said first velocity and wherein said extractor means further includes means for accelerating items caused to move by said engaging means, said accelerating means causing the velocity of the engaged items to be increased to approximately the velocity of said receiver conveyor means.

12. The apparatus of claim 11 wherein each of said carriers further includes motion arresting means located within the channel, said arresting means applying a resilient biasing force for urging an item against the wall of said channel and retaining the item in said channel, said engaging means overcoming said retaining force.

13. The apparatus of claim 11 further comprising:

means positioned at the downstream end of said first conveyor means for inserting items into said buffer means carriers.

14. The apparatus of claim 13 further comprising:

damping means positioned at a point disposed generally oppositely with respect to said inserting means for absorbing any momentum retained by an item which reaches the end of a said channel opposite to the insertion end.

15. A system for conveying paper items bearing machine readable indicia, the paper items having a length in each of three dimensions with the length in the first dimension being much smaller than the length in the other two dimensions, each of the dimension lengths defining a direction, said item first dimension being thickness, said system comprising:

first linear conveyor means for transporting the items in serial, spaced apart relationship in the direction of one of said other dimension lengths at a first velocity;

buffer means for receiving the items from said first conveyor means and transporting the said items, said buffer means defining a receiving station substantially in alignment with said first conveyor means, said buffer means including a plurality of closely spaced item carriers which move along a continuous path, said path being angularly related to the direction of item motion on said first conveyor means, items being transported on said first conveyor means being inserted serially and individually into a said carrier, said carriers moving said items in the direction of said item first dimension length at a second velocity which insures availability of an empty carrier to receive a next incoming item from said first conveyor means, each of said carriers comprising means for receiving and supporting a said item, said carriers each further comprising means for establishing a retarding frictional force proportional to item thickness and mass whereby the motion of items received from said first conveyor means will be gradually arrested within each said carrier;

receiver conveyor means for transporting the items in serial, spaced apart relationship in the said direction of said one of said other dimension lengths, said receiver conveyor means defining a discharge station substantially in alignment with a region on said buffer means which is displaced from said receiving station; and extractor means for removing the contents of said buffer means carriers and delivering the removed items to said receiver conveyor means.

16. The apparatus of claim 15 wherein a portion of said extractor means is positioned over said buffer means and wherein said extractor means includes means for engaging an edge of an item to impart motion to the said engaged item in the direction of motion of said receiver conveyor means, said engaging means causing the engaged item to move in the same direction as the item was moved as it was inserted into the carrier.

17. The apparatus of claim 16 further comprising:

means positioned at the end of said first conveyor means for inserting items into said buffer means carriers at approximately said first velocity.

18. A system for conveying paper items bearing machine readable indicia, the paper items having a length in each of three dimensions with the length in the first dimension being much smaller than the length in the other two dimensions, each of the dimension lengths defining a direction, said system comprising:

first linear conveyor means for transporting the items in serial, spaced apart relationship in the direction of one of said other dimension lengths at a first velocity, the first conveyor means having a downstream end;

buffer means for receiving the items from said first conveyor means and transporting the said items, said buffer means defining a receiving station in alignment with said first conveyor means, said buffer means including a plurality of closely spaced item carriers which move along a continuous path, said path being angularly related to the direction of item motion on said first conveyor means, items being transported on said first conveyor means being inserted serially and individually into a said carrier, said carriers moving said items in the direction of said item first dimension length at a second velocity which insures availability of an empty carrier to receive a next incoming item from said first conveyor means;

means positioned at the downstream end of said first conveyor means for inserting items into said buffer means carriers;

damping means positioned at a fixed location on the opposite side of said buffer means from said inserting means for absorbing any momentum forces of an item caused to travel the full length of one of said carriers;

receiver conveyor means for transporting the items in serial, spaced apart relationships in the said direction of said one of said other dimension lengths, said receiver conveyor means defining a discharge station in alignment with a region on said buffer means which is displaced from said receiving station; and extractor means for removing the contents of said buffer means carriers and delivering the removed items to said receiver conveyor means.

* * * * *